US007707945B2

(12) United States Patent
Iszkula et al.

(10) Patent No.: US 7,707,945 B2
(45) Date of Patent: May 4, 2010

(54) SAFETY SYSTEM FOR A LOCOMOTIVE WALKWAY

(75) Inventors: Carl S. Iszkula, Girard, PA (US); Leroy Learn, North East, PA (US); Soban Jalil, Erie, PA (US)

(73) Assignee: General Electric Company, Schenectady, NY (US)

( * ) Notice: Subject to any disclaimer, the term of this patent is extended or adjusted under 35 U.S.C. 154(b) by 492 days.

(21) Appl. No.: 11/557,525

(22) Filed: Nov. 8, 2006

(65) Prior Publication Data

US 2008/0105157 A1 May 8, 2008

(51) Int. Cl.
*B61C 17/04* (2006.01)

(52) U.S. Cl. ..... 105/457

(58) Field of Classification Search ..... 105/425, 105/436, 439, 440, 442, 443, 449, 450, 457–460
See application file for complete search history.

(56) References Cited

U.S. PATENT DOCUMENTS 4,757,768 A * 7/1988 Agelakopoulos ..... 105/457

* cited by examiner

*Primary Examiner*—S. Joseph Morano
*Assistant Examiner*—Robert J McCarry, Jr.
(74) *Attorney, Agent, or Firm*—Robert Wawrzyn, Esq.; Cian G. O'Brien, Esq.; Beusse Wolter Sanks Mora & Maire, P.A.

(57) ABSTRACT

A safety system for a walkway of a locomotive. The safety system includes an operator cabin adjacent to a front end of the locomotive, and a walkway extending from the operator cabin along a first side of the locomotive to facilitate a locomotive operator performing regular maintenance. More particularly, the safety system includes a resistive grid exhaust in a sidewall of the first side of the locomotive for directing hot air along a path from a resistive grid within the sidewall to external the locomotive during a self-load mode of the locomotive. A barrier bar is positioned adjacent to the base of the resistive grid exhaust, and is extendable to an extended position over the walkway during the self-load mode to prevent the operator from walking into the path of the hot air from the resistive grid exhaust. Upon the barrier bar retracting from the extended position over the walkway, the locomotive switches out of the self-mode into a normal mode to shut off the supply of the hot air from the resistive grid through the resistive grid exhaust to permit the operator to safely walk in front of the resistive grid exhaust.

25 Claims, 4 Drawing Sheets

SAFETY SYSTEM FOR A LOCOMOTIVE WALKWAY

FIELD OF THE INVENTION

This field of the invention relates generally to safety systems for locomotives, and more particularly to safety systems for locomotive walkways.

BACKGROUND OF THE INVENTION

In a conventional diesel-electric locomotive, drive traction motors provide the motive force to move the train. Typically, a diesel engine drives an alternator, which supplies current to drive traction motors, which, in turn, propel the locomotive forward or backward. When propelled as such, a locomotive is said to be motoring.

The traction motors, however, perform an additional function. Once the locomotive is in motion, traction motors may be configured to generate electricity instead of consuming it. As generators, the traction motors convert the locomotive's kinetic energy into electrical energy, thereby slowing the locomotive. Using the traction motors to reduce speed is called dynamic braking. Because there is no suitable storage medium for the generated electrical energy, an electrically resistive grid is used to convert the electrical energy into heat energy, which is vented to the atmosphere through a resistive grid exhaust on one side of the locomotive. The resistance grid exhaust is adjacent to an operator cabin and a walkway used by the operator during regular maintenance when the locomotive is stationary.

While the locomotive is stationary, during a self-load mode, the resistive grid may be used to test load a locomotive's power alternator and diesel engine. The resistive grid is disconnected from the traction motors and connected to the locomotive's alternator, and continues to convert electrical energy to heat energy, which is vented out through the resistive grid exhaust, as in the dynamic braking mode. When the locomotive is stationary, such as in the self-load mode, the operator may walk on the walkway to perform regular maintenance, and thus be positioned in the vicinity of the resistive grid exhaust. Accordingly, there is a need to provide additional safety in the walkway area to address these circumstances.

BRIEF DESCRIPTION OF THE INVENTION

In one embodiment of the present invention, a safety system is provided for a walkway of a locomotive. The safety system includes an operator cabin adjacent to the front end of the locomotive, and a walkway extending from the operator cabin along a first side of the locomotive to facilitate a locomotive operator performing regular locomotive maintenance. A resistive grid exhaust is positioned in a sidewall of the first side of the locomotive to direct hot air along a path from a resistive grid within the sidewall to external the locomotive during a self-load mode of the locomotive. More particularly, a barrier bar is positioned adjacent to the base of the resistive grid exhaust to extend to an extended position over the walkway during the self-load mode and prevent the operator from walking into the path of hot air from the resistive grid exhaust. Additionally, the barrier bar retracts from the extended position over the walkway to switch the locomotive out of the self-load mode into a normal mode to shut off the supply of hot air from the resistive grid through the resistive grid exhaust to permit the operator to safely walk in front of the resistive grid exhaust.

In another embodiment of the present invention, a locomotive control system is provided for a locomotive. The locomotive includes a normal mode for supplying electrical current from an engine and alternator to drive traction motors to propel the locomotive. The locomotive also includes a self-load mode for supplying electrical current from the engine and alternator to a resistive grid while the locomotive is stationary. The locomotive control system includes a controller coupled to a barrier bar switch for selectively isolating the resistive grid from the engine and alternator and switching out of the self-load mode into the normal mode based upon receiving an engaged signal from the barrier bar switch upon the barrier bar engaging the barrier bar switch.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
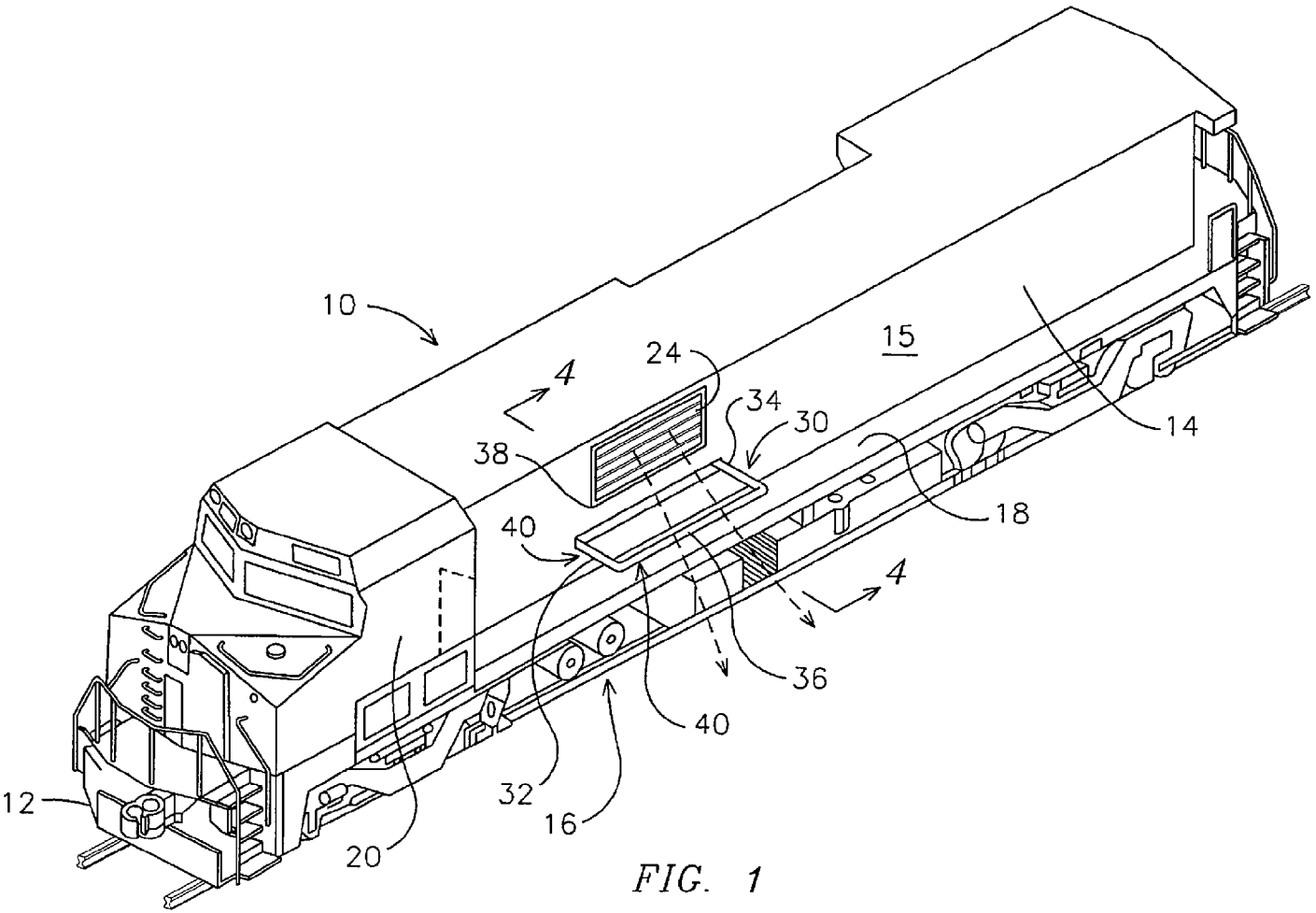
FIG. 1 is a perspective view of a locomotive in a self-load mode.
Figure 3:
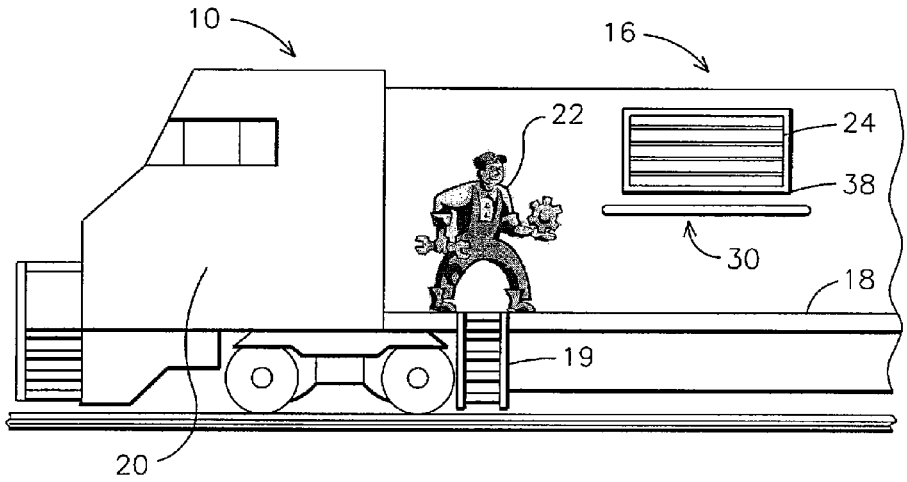
FIG. 3 is an exemplary partial side view of a locomotive.

FIG. 1 illustrates a locomotive 10 including an embodiment of a safety system 16 for a walkway 18 of the locomotive. The safety system 16 illustratively includes an operator cabin 20 adjacent to a front end 12 of the locomotive 10. A walkway 18 extends from the operator cabin 20 along a first side 14 of the locomotive 10 to facilitate a locomotive operator 22 performing regular maintenance on the locomotive. As shown in FIG. 3, the locomotive operator 22 may perform such regular maintenance on the walkway 18, or may descend a ladder 19 to perform the regular maintenance of the locomotive while standing on the ground. The second side of the locomotive (not shown) opposite from the first side 14 may not include a ladder to provide such ground access.

Figure 2:
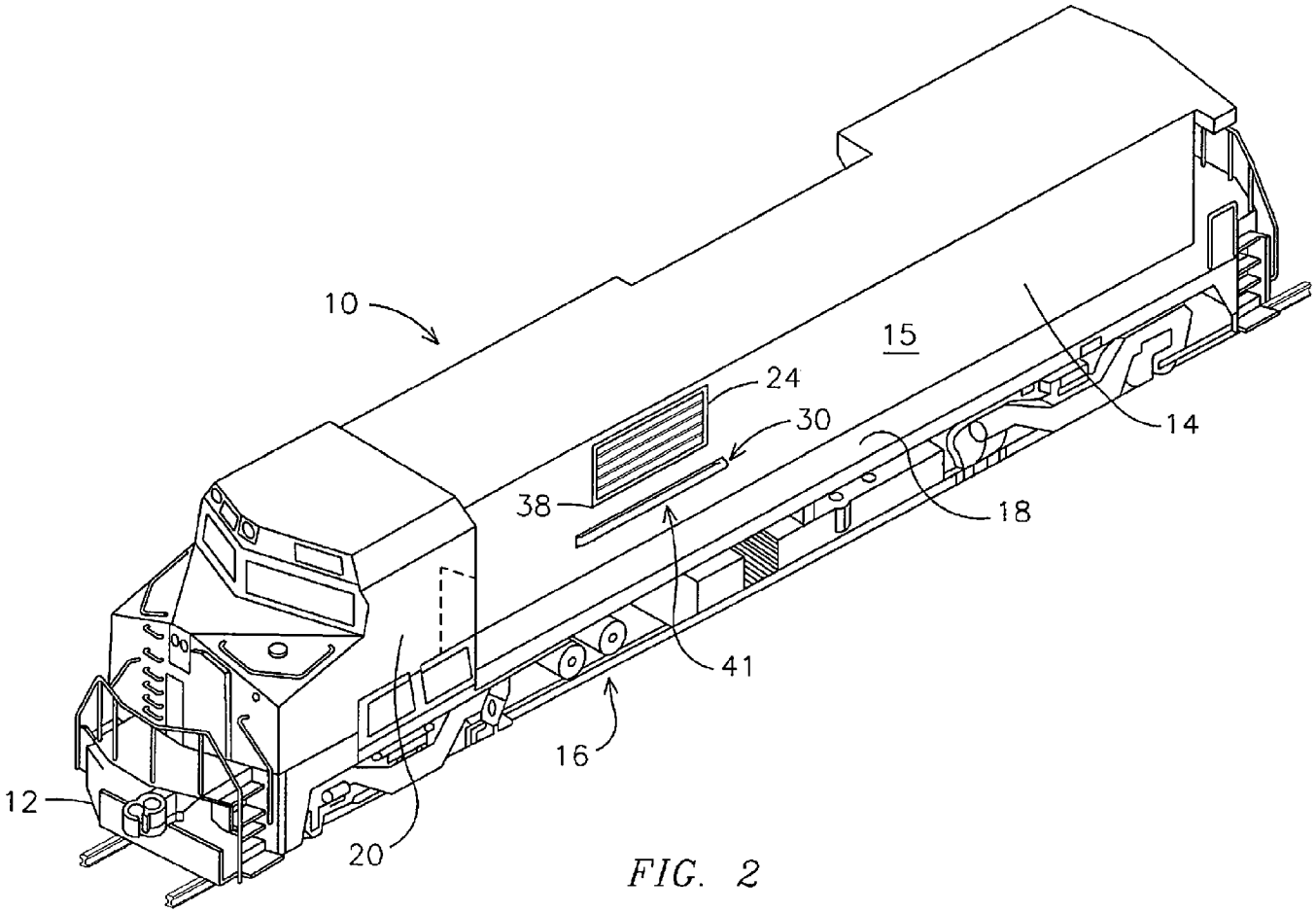
FIG. 2 is a perspective view of a locomotive in a normal mode.

A resistive grid exhaust 24 is illustratively positioned within the sidewall 15 of the first side 14 of the locomotive 10. The resistive grid exhaust 24 directs hot air along a path 26 (FIG. 4) from a resistive grid 28 within the sidewall 15 to external the locomotive 10 during a self-load mode of the locomotive. As illustrated in FIG. 1, the hot air directed away from the resistive grid exhaust 24 during the self-load mode passes over the walkway 18. A barrier bar 30 is positioned adjacent to the base 38 of the resistive grid exhaust 24, and is extendable to an extended position 40 (FIG. 1) over the walkway 18 during the self-load mode. By extending to the extended position 40 during the self-load mode, the barrier bar 30 prevents the operator 22 from walking into the path 26 of the hot air from the resistive grid exhaust 24, which may cause personal injury to the operator. The barrier bar 30 may retract from the extended position 40 (FIG. 2) over the walkway 18 to switch the locomotive 10 out of the self-load mode and into a normal mode to shut off the supply of the hot air from the resistive grid 28 through the resistive grid exhaust 24. By retracting from the extended position 40 and switching the locomotive 10 to the normal mode, the barrier bar 30 permits the operator 22 to safely walk down the walkway 18 and in front of the resistive grid exhaust 24. FIG. 2 illustrates the barrier bar 30 in a fully retracted position 41, such that a negligible amount of the barrier bar extends over the walkway 18. However, the fully retracted position may be any position of the barrier bar such that there is no substantial obstruction to the operator 22 walking down the walkway 18 and passing the resistive grid exhaust 24. The barrier bar 30 may be retracted from the extended position 40 by the operator 22 physically shifting the barrier bar inward toward the sidewall 15, or automatically upon the locomotive shifting from the self-load mode to the normal mode, based upon a locomotive controller.

Figure 4:
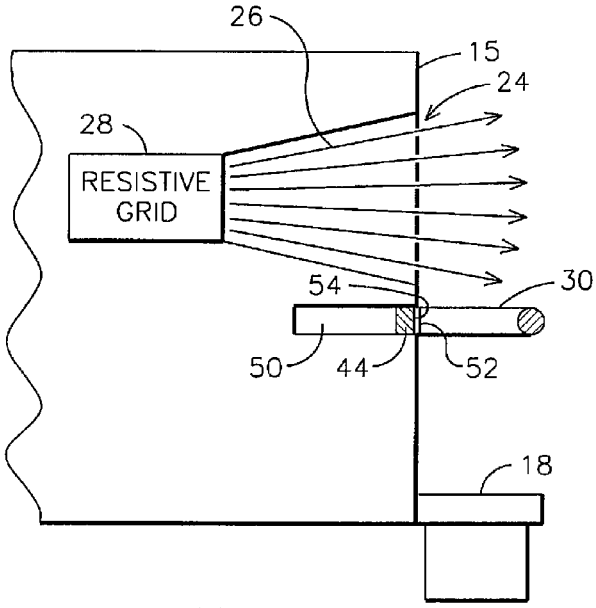
FIG. 4 is a partial cross-sectional view of the locomotive of FIG. 1 along the line 4-4.

The barrier bar 30 is illustratively centered with the resistive grid exhaust 24 upon extending to the extended position 40 and retracting to the fully retracted position 41, as shown in respective FIGS. 1 and 2. The overall width of the barrier bar 30 is at least equal to the width of the resistive grid exhaust 24. Since the hot air passing out of the resistive grid exhaust 24 would be felt by an operator 22 standing at the respective sides of the resistive grid exhaust, the overall width of the barrier bar is preferably larger than the resistive grid exhaust, as shown in FIGS. 1 and 2. As best illustrated in FIG. 4, the barrier bar 30 in the extended position 40 is substantially perpendicular to the sidewall 15 of the first side 14 of the locomotive 10. However, the barrier bar in the extended position may be oriented other than substantially perpendicular with the sidewall 15 of the first side 14 of the locomotive 10, provided that the barrier bar in such extended position prevents the operator 22 from walking into the path of the hot air from the resistive grid exhaust 24 during the self-load mode. Although FIGS. 1 and 2 illustrate one resistive grid exhaust and barrier bar on the first side of the locomotive, the safety system embodiment of the present invention would accommodate a plurality of resistive grid exhausts and corresponding barrier bars along the first side, or both sides of a locomotive, as appreciated by one of skill in the art.

As illustrated in FIG. 4, a barrier bar switch 44 engages the barrier bar 30 when the barrier bar retracts from the extended position 40. The barrier bar switch 44 further disengages the barrier bar 30 when the barrier bar extends to the extended position 40. The barrier bar 30 illustratively extends from a respective slot 50 within the sidewall 15 of the first side 14. The slot 50 slidably receives the barrier bar 30 when the barrier bar retracts from the extended position 40, and slidably receives a portion 54 of the barrier bar switch to engage an adjacent portion 52 of the barrier bar upon the barrier bar retracting from the extended position. The safety system embodiment of the present invention includes other coupling structures between the barrier bar and the barrier bar switch from the extended position to retracting from the extended position, in addition to the slot structure illustrated in FIG. 4, for example. Such coupling structures are arranged such that the barrier bar switch disengages the barrier bar when the barrier bar extends to the extended position, and engages the barrier bar when the barrier bar retracts from the extended position.

The barrier bar 30 illustratively forms a u-shape with a hollow center. The barrier bar 30 includes a first bar 32 and a second bar 34, aligned mutually parallel and substantially perpendicular to the sidewall 15 of the first side 14 when the barrier bar 30 is in the extended position 40. The first and second parallel bars 32,34 are separated by a distance at least equal to the width of the resistive grid exhaust 24. A third bar 36 is illustratively aligned substantially perpendicular with the first and second bars 32,34 and substantially parallel with the sidewall 15 of the first side 14. The third bar 36 has a length at least equal to the width of the resistive grid exhaust 24. The third bar 36 is integrated with the first and second bars 32,34 at a first end of the first bar and a first end of the second bar opposite from the sidewall 15 of the first side 14 when the barrier bar 30 is in the extended position 40. The barrier bar may take any form which prevents the operator 22 from walking into the path of the hot air from the resistive grid exhaust 24 during the self-load mode when the barrier bar is in the extended position.

The barrier bar 30 may be comprised of a metallic substance, or any material appreciated by one of skill in the art. The barrier bar 30 in the extended position 40 is capable of supporting the weight of the operator 22, particularly in the event that the operator needs to use the barrier bar for stability in avoiding the hot path of air from the resistive grid exhaust 24. In an exemplary embodiment of the barrier bar 30, the barrier bar in the extended position may be capable of supporting the weight of a 400 lb operator.

Figure 5:
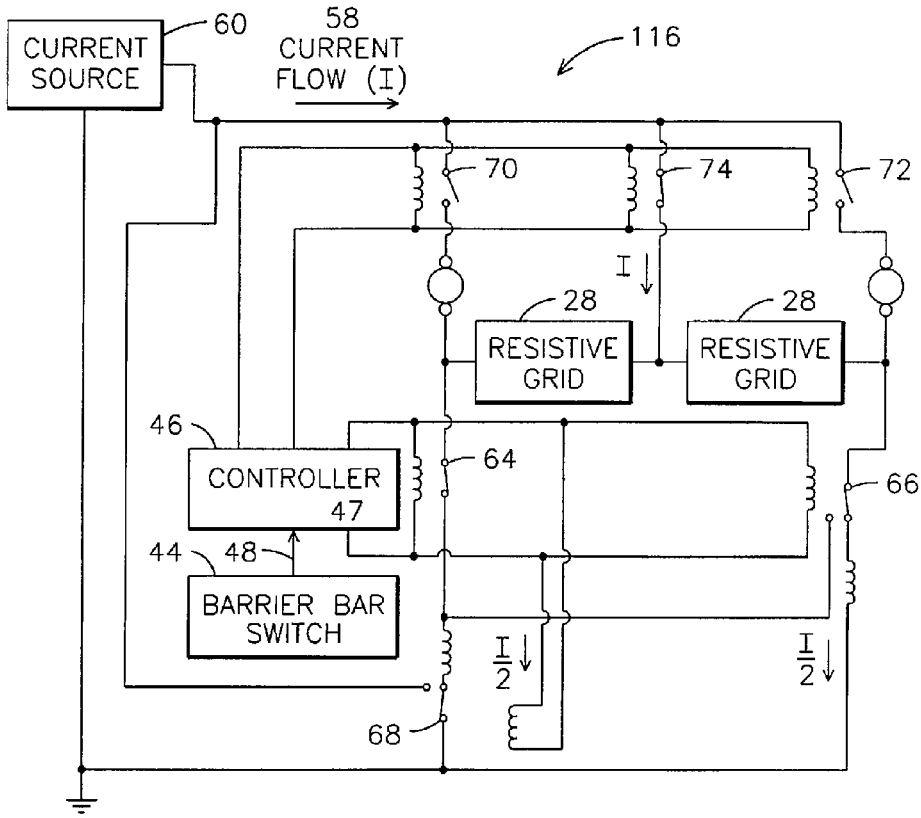
FIG. 5 is a block diagram of the locomotive control system for the locomotive of FIG. 1.

Another embodiment of the present invention includes a locomotive control system 116 for a locomotive 10 having a normal mode for supplying electrical current from an engine and alternator (ie. current source 60) to drive traction motors to propel the locomotive. FIG. 5 illustrates an exemplary embodiment of a locomotive system 116 of the present invention. The locomotive control system 116 further includes a self-load mode for supplying electrical current 58 from the engine and alternator (ie. current source 60) to a resistive grid 28 while the locomotive is stationary. The braking switches 64,66, and 68 are configured for the normal mode, but the motor/brake switches 70,72 have opened to disconnect the traction motor from the current source 60. A self-load switch 74 is closed to connect the resistive grids 28 to the current source 60. The current source 60 and the resistive grids 28 may now be tested without moving the locomotive 10. The locomotive control system 116 includes the resistive grid exhaust 24 continuous with the resistive grid 28 and the barrier bar 30, as discussed above.

Figure 7:
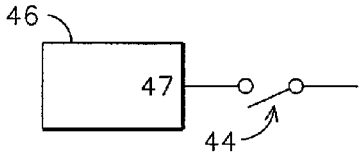
FIG. 7 is a partial block diagram of an exemplary locomotive control system including a locomotive controller coupled to a barrier bar switch.
Figure 6:
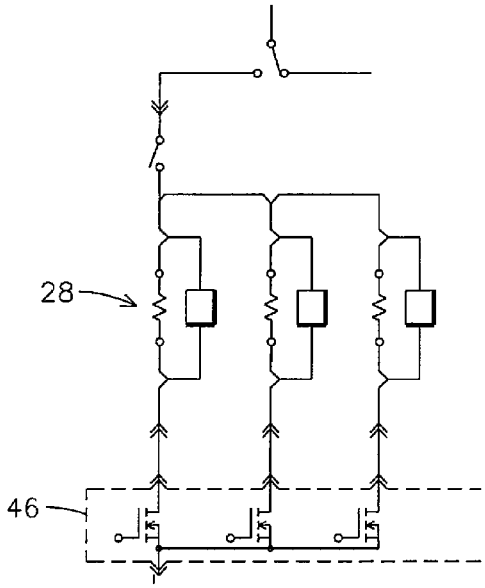
FIG. 6 is a plan view of an exemplary locomotive control system including a control circuit related to a resistive grid coupled to a locomotive controller.

As illustrated in the exemplary embodiment of FIG. 5, the locomotive control system 116 further includes a controller 46 coupled to the barrier bar switch 44 for selectively isolating the resistive grid 28 from the engine and alternator (ie. current source 60) and switching out of the self-load mode into the normal mode based upon receiving an engaged signal from the barrier bar switch upon the barrier bar 30 engaging the barrier bar switch 44. As illustrated in FIGS. 5 and 7, the controller 46 permits the hot air to be directed along the path 26 through the resistive grid exhaust 24 and maintains the self-load mode based upon receiving a disengaged signal 48 from the barrier bar switch 44 at a digital input 47. An exemplary embodiment of a resistive grid 28 coupled to a controller 46 is illustrated in FIG. 6.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A safety system for a walkway of a vehicle comprising:

an operator cabin;

a walkway extending from said operator cabin along a first side of said vehicle;

at least one resistive grid exhaust in a sidewall of said first side of said vehicle for directing hot air along a path from a resistive grid within said sidewall to external said vehicle during a self-load mode of said vehicle; and at least one barrier bar positioned adjacent said at least one resistive grid exhaust, said at least one barrier bar for extending to an extended position over said walkway during said self-load mode to prevent an operator from walking into said path of said hot air from said resistive grid exhaust, and for retracting from said extended position over said walkway for switching out of said self-load mode into a normal mode of said vehicle to shut off the supply of said hot air from said resistive grid through said at least one resistive grid exhaust to permit said operator to safely walk in front of said at least one resistive grid exhaust.

2. The safety system according to claim 1, wherein said at least one barrier bar in said extended position is centered with said at least one resistive grid exhaust;

and wherein said at least one barrier bar includes a width at least equal to the width of said at least one resistive grid exhaust.

3. The safety system according to claim 1, wherein said at least one barrier bar in said extended position is substantially perpendicular to said sidewall of said first side.

4. The safety system according to claim 1, further comprising:

a barrier bar switch for engaging said at least one barrier bar upon said at least one barrier bar retracting from said extended position, and said barrier bar switch for disengaging said at least one barrier bar in said extended position; and a controller coupled to said barrier bar switch for shutting off the supply of said hot air from said resistive grid through said at least one resistive grid exhaust and switching out of said self-load mode into said normal mode based upon receiving an engaged signal from said barrier bar switch upon said at least one barrier bar engaging said barrier bar switch.

5. The safety system according to claim 4, wherein said controller is further for permitting said hot air to be directed through said at least one resistive grid exhaust and maintaining said self-load mode while receiving a disengaged signal from said barrier bar switch.

6. The safety system according to claim 4, wherein said at least one barrier bar extends from a respective slot within said sidewall of said first side, said at least one slot for slidably receiving said at least one barrier bar upon retracting from said extended position and for slidably receiving a portion of said barrier bar switch for engaging an adjacent portion of said at least one barrier bar upon said at least one barrier bar retracting from said extended position.

7. The safety system according to claim 1, wherein each of said at least one barrier bar forms a u-shape;

and wherein said at least one u-shape barrier bar comprises a hollow center.

8. The safety system according to claim 7, wherein said at least one u-shape barrier bar comprises:

a first and second bar, said first and second bar aligned mutually parallel and substantially perpendicular to said sidewall of said first side upon said at least one barrier bar in said extended position, said first and second parallel bar separated by a distance at least equal to the width of said at least one resistive grid exhaust; and a third bar aligned substantially perpendicular with said first and second bar and substantially parallel with said sidewall of said first side, said third bar having a length at least equal to the width of said at least one resistive grid exhaust;

said third bar integrated with said first and second bar at a first end of said first bar and a first end of said second bar opposite from said sidewall of said first side when said at least one barrier bar is in said extended position.

9. The safety system according to claim 1, wherein each of said at least one barrier bar is comprised of a metallic substance.

10. The safety system according to claim 1, wherein each of said at least one barrier bar in said extended position is for supporting the weight of the operator.

11. A locomotive control system for a locomotive having a normal mode for supplying electrical current from an engine and alternator to drive traction motors to propel the locomotive, and a self-load mode for supplying electrical current from the engine and alternator to a resistive grid while the locomotive is stationary, the locomotive control system comprising:

at least one resistive grid exhaust continuous with said resistive grid for directing hot air from said resistive grid to external the locomotive during said self-load mode, and positioned in a sidewall of a first side of the locomotive adjacent to an operator cabin and a walkway extending from said operator cabin to beyond an opposite side of said at least one resistive grid exhaust from said operator cabin;

at least one barrier bar positioned adjacent a base of said resistive grid exhaust, said at least one barrier bar for extending to an extended position over said walkway to disengage a barrier bar switch during said self-load mode and for retracting from said extended position over said walkway to engage a barrier bar switch during said normal mode; and a controller coupled to said barrier bar switch for selectively isolating said resistive grid from said engine and alternator and switching out of said self-load mode into said normal mode based upon receiving an engaged signal from said barrier bar switch upon said at least one barrier bar engaging said barrier bar switch.

12. The locomotive control system according to claim 11, wherein said at least one barrier bar in said extended position is centered with said at least one resistive grid exhaust;

and wherein said at least one barrier bar includes a width at least equal to the width of said at least one resistive grid exhaust.

13. The locomotive control system according to claim 11, wherein said controller is further for permitting said hot air to be directed through said at least one resistive grid exhaust and maintaining said self-load mode while receiving a disengaged signal from said barrier bar switch.

14. The locomotive control system according to claim 11, wherein said at least one barrier bar extends from a respective slot within said sidewall of said first side, said at least one slot for slidably receiving said at least one barrier bar upon retracting from said extended position and for slidably receiving a portion of said barrier bar switch for engaging an adjacent portion of said at least one barrier bar upon said at least one barrier bar retracting from said extended position.

15. The locomotive control system according to claim 11, wherein each of said at least one barrier bar forms a u-shape.

16. The locomotive control system according to claim 15, wherein said at least one u-shape barrier bar comprises:

a first and second bar, said first and second bar aligned mutually parallel and substantially perpendicular to said sidewall of said first side upon said at least one barrier bar in said extended position, said first and second parallel bar separated by a distance at least equal to the width of said at least one resistive grid exhaust; and a third bar aligned substantially perpendicular with said first and second bar and substantially parallel with said sidewall of said first side, said third bar having a length at least equal to the width of said at least one resistive grid exhaust;

said third bar integrated with said first and second bar at a first end of said first bar and a first end of said second bar opposite from said sidewall of said first side when said at least one barrier bar is in said extended position.

17. A locomotive control system comprising:

at least one resistive grid exhaust continuous with a resistive grid for directing hot air from said resistive grid to external the locomotive during a self-load mode, and positioned in a sidewall of a first side of the locomotive adjacent to an operator cabin and a walkway extending from said operator cabin to beyond an opposite side of said at least one resistive grid exhaust from said operator cabin;

at least one barrier bar positioned adjacent a base of said resistive grid exhaust, said at least one barrier bar for extending to an extended position over said walkway to disengage a barrier bar switch during said self-load mode and for retracting from an extended position over said walkway to engage a barrier bar switch during a normal mode; and a controller coupled to said barrier bar switch for selectively shutting down said hot air from said resistive grid to said at least one resistive grid exhaust and switching out of said self-load mode into said normal mode based upon receiving an engaged signal from said barrier bar switch upon said at least one barrier bar engaging said barrier bar switch.

18. The locomotive control system according to claim 17, wherein said at least one barrier bar in said extended position is centered with said at least one resistive grid exhaust, and includes a width at least equal to the width of said at least one resistive grid exhaust.

19. The locomotive control system according to claim 17, wherein said controller is further for permitting said hot air to be directed through said at least one resistive grid exhaust and maintaining said self-load mode while receiving a disengaged signal from said barrier bar switch.

20. The locomotive control system according to claim 17, wherein said at least one barrier bar extends from a respective slot within said sidewall of said first side, said at least one slot for slidably receiving said at least one barrier bar upon retracting from said extended position and for slidably receiving a portion of said barrier bar switch for engaging an adjacent portion of said at least one barrier bar upon said at least one barrier bar retracting from said extended position.

21. The locomotive control system according to claim 17, wherein each of said at least one barrier bar forms a u-shape.

22. The locomotive control system according to claim 21, wherein said at least one u-shape barrier bar comprises:

a first and second bar, said first and second bar aligned mutually parallel and substantially perpendicular to said sidewall of said first side upon said at least one barrier bar in said extended position, said first and second parallel bar separated by a distance at least equal to the width of said at least one resistive grid exhaust; and a third bar aligned substantially perpendicular with said first and second bar and substantially parallel with said sidewall of said first side, said third bar having a length at least equal to the width of said at least one resistive grid exhaust;

said third bar integrated with said first and second bar at a first end of said first bar and a first end of said second bar opposite from said sidewall of said first side when said at least one barrier bar is in said extended position.

23. A safety system for a vehicle comprising:

an operator cabin;

a walkway extending from said operator cabin along a first side of said vehicle;

at least one exhaust in a sidewall of the first side of the vehicle, wherein the vehicle is operable in a first mode wherein hot air is expelled from internal to the vehicle to external the vehicle through the exhaust and across the walkway, and wherein the vehicle is operable in a second mode wherein hot air is not expelled through the exhaust; and at least one barrier bar positioned adjacent the exhaust, the at least one barrier bar extending to an extended position over the walkway during the first mode to prevent an operator from walking into the path of the hot air expelled through the exhaust, and the at least one barrier bar retracting from the extended position over the walkway during the second mode, for permitting the operator to safely walk in front of the exhaust.

24. The safety system of claim 23 wherein the at least one barrier bar is automatically extended into the extended position when the vehicle operates in the first mode, and wherein the at least one barrier bar is automatically retracted from the extended position when the vehicle operates in the second mode.

25. The safety system of claim 23 wherein manual movement of the at least one barrier bar out of the extended position causes the vehicle to automatically operate in the second mode.

* * * * *